United States Patent [19]

Arp et al.

[11] 4,364,211

[45] Dec. 21, 1982

[54] POOL PANEL CONNECTOR SYSTEM

[75] Inventors: George F. Arp, Fairport, N.Y.; James M. Nichols, Old Saybrook, Conn.

[73] Assignee: Heldor Associates, Inc., Morris Township, Morris County, N.J.

[21] Appl. No.: 213,934

[22] Filed: Dec. 8, 1980

[51] Int. Cl.[3] ..... E04H 3/18

[52] U.S. Cl. ..... 52/245; 52/169.7; 52/582

[58] Field of Search ..... 52/582, 583, 586, 288, 52/245, 246, 247, 602, 588, 169.7; 4/506

[56] References Cited

U.S. PATENT DOCUMENTS

| | | | |
|---|---|---|---|
| Re. 29,936 | 3/1979 | Arp | 52/169.7 |
| 2,589,304 | 3/1952 | Spangler | 52/588 |
| 3,094,709 | 6/1963 | Miccio | 52/169.7 |
| 3,818,669 | 6/1974 | Moss | 52/582 |
| 3,840,908 | 10/1974 | Greene | 52/169.7 |
| 3,893,269 | 7/1975 | Nelsson | 52/245 |
| 3,959,830 | 6/1976 | van den Broek | 52/288 |
| 4,048,773 | 9/1977 | Laven | 52/169.7 |
| 4,055,922 | 11/1977 | Ellington | 52/245 |
| 4,070,866 | 1/1978 | Juvrud | 52/245 |
| 4,124,907 | 11/1978 | Laven | 52/169.7 |
| 4,177,614 | 12/1979 | Arp | 4/506 |

*Primary Examiner*—Reinaldo P. Machado
*Attorney, Agent, or Firm*—Stonebraker, Shepard & Stephens

[57] ABSTRACT

The inventive system interconnects molded resin panels to form a secure and reliable pool wall. Each panel 10 has a facing wall 11, base flange 12, and top flange 13, and each end of facing wall 11 has vertical margins 15 approximately aligned with wall 11 and juxtaposed between adjacent panels. Each margin has an outer groove 16 and an inner groove 17 that extend for the vertical length of margin 15 and are spaced laterally and disposed obliquely to each other. Panels 10 are positioned in a predetermined orientation to each other and are joined together at their margins by vertical locking strips 20. Locking strips 20 have an H-bar shape with a cross web 21 positioned between juxtaposed margins 15 and inner span 22 and outer span 23 overlapping margins 15. Acutely in-turned ribs 14 on the vertical edges of inner and outer spans 22 and 23 engage in margin grooves 16 and 17 and secure margins 15 together. Bottom flange 12 and top flange 13 extend beyond margins 15 and overlap outside margins 15 where they are bolted together to maintain the predetermined orientation of the panels.

17 Claims, 9 Drawing Figures

FIG. 4
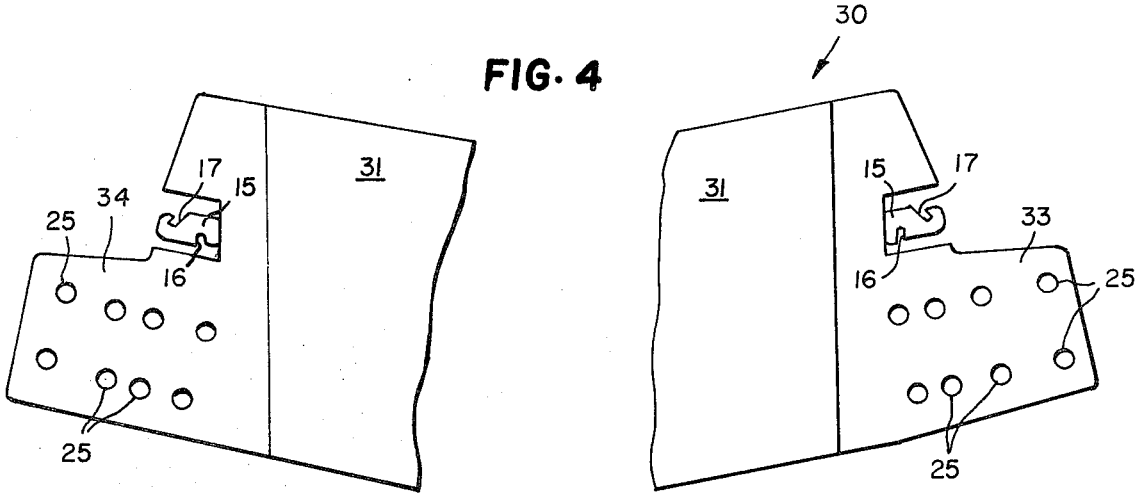
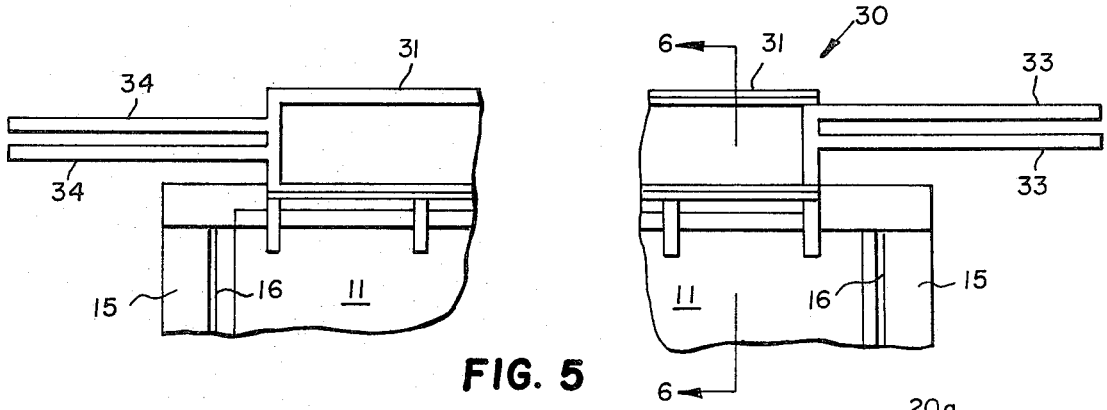
FIG. 5
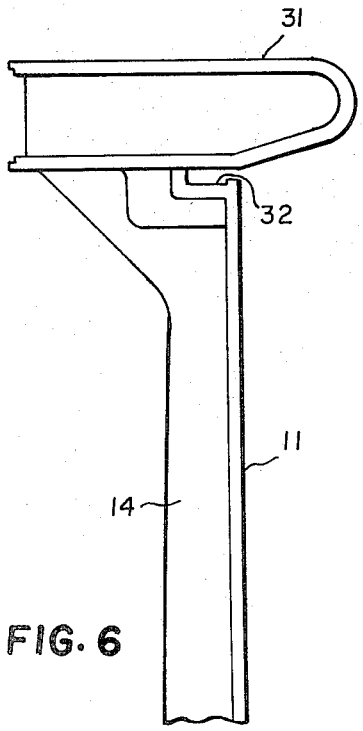
FIG. 6
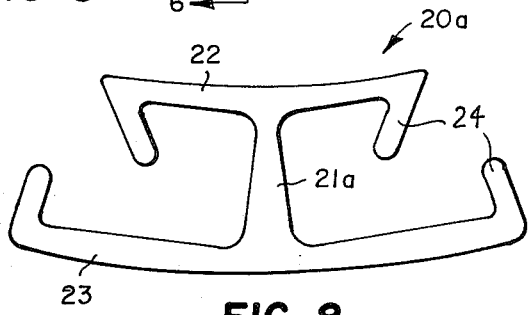
FIG. 8
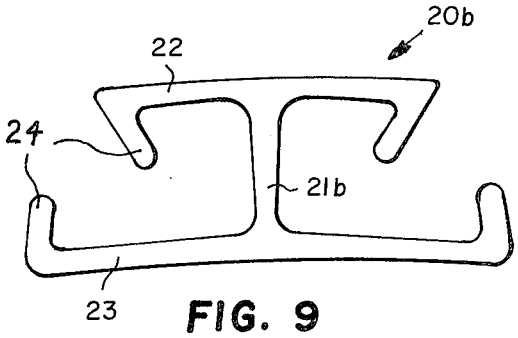
FIG. 9

POOL PANEL CONNECTOR SYSTEM

BACKGROUND

Many different materials and assemblies have been used for swimming pool walls, and many of these have been eliminated in an evolution toward economy, simplicity, and reliability. Swimming pools are highly competitive and the costs include materials, fabrication, storing and shipping, and assembly, with the reliability of the results being competitive for durability and good looks.

Pool panels prefabricated of resinous materials offer several cost advantages if they can meet other requirements. They can be molded efficiently and made light in weight and economical to ship, and they resist deterioration for a potentially long life. However, they must achieve high strength without requiring too much material or molding expense. They must also avoid complex assembly operations so they can be put together easily and quickly by unskilled labor without requiring special tools. The joints must be adequately strong without being unduly expensive, and the assembled wall must be strong enough to resist the expected forces from the pool water and any surrounding earth to hold its shape for many years. Failure to meet all of these requirements has defeated many previous suggestions.

This invention involves analysis of all the problems and requirements for pool walls and proposes a better system for connecting resin pool wall panels to form durable and reliable arcs. The inventive system provides strong and secure joints between panels, disposes panels for maximum strength along lines of tension, distributes stress evenly over wide areas of each panel, and allows simple and labor-saving joinery. The invention also keeps molding costs to a low level, economizes on materials, and accommodates both below ground and above ground pool walls in arcs of different radii.

SUMMARY

The inventive system forms an arc-shaped pool wall of molded resin panels that are securely interconnected and braced. Vertical margins at each end of facing walls for each panel are juxtaposed and interlocked, and base and top flanges for each panel extend beyond and outside the margins where they overlap in predetermined orientations and are bolted together to brace the joint. The margins of the facing wall have vertical inner and outer grooves that are laterally spaced and oblique to each other, and a vertical locking strip that is generally H-shaped in cross section straddles and holds the margins together. The locking strip has a cross web disposed between the juxtaposed margins and has inner and outer spans that overlap the margins. The vertical edges of the inner and outer spans have acutely inturned ribs that engage in the grooves of the margins. By changing the angle of the locking strip and the overlapped position of the base and top flanges, the panels can be interlocked to approximate arcs of different curvature.

DRAWINGS

FIG. 4 is a fragmentary plan view of an embodiment preferred for an above ground pool panel according to the invention;

FIG. 5 is a fragmentary, rear elevational view of the panel of FIG. 4;

FIG. 6 is a cross-sectional view of the panel of FIG. 5, taken along the line 6—6 thereof;

FIGS. 8 and 9 are enlarged plan views of angled locking strips for joining panels at different orientations to form arcs of different curvature.

DETAILED DESCRIPTION

The inventive pool panel connector system applies to pool wall panels molded of resinous material and arranged to form a curved pool wall. The panels can form walls for inground or above ground pools and can form arcs of different radii. The panels are molded within a cavity mold by generally known molding techniques using generally known resinous compositions that can include fillers and fibrous reinforcement. The inventive connector system involves both panel configuration and a panel interlocking arrangement to meet all the requirements for a sturdy and economical pool wall.

Figure 1:
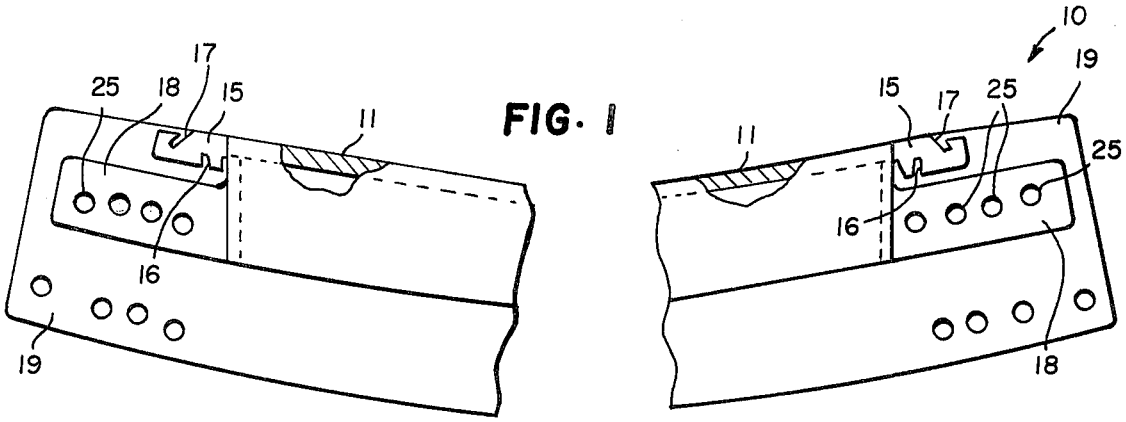
FIG. 1 is a fragmentary plan view of an embodiment preferred for an inground pool panel according to the invention.
Figure 2:
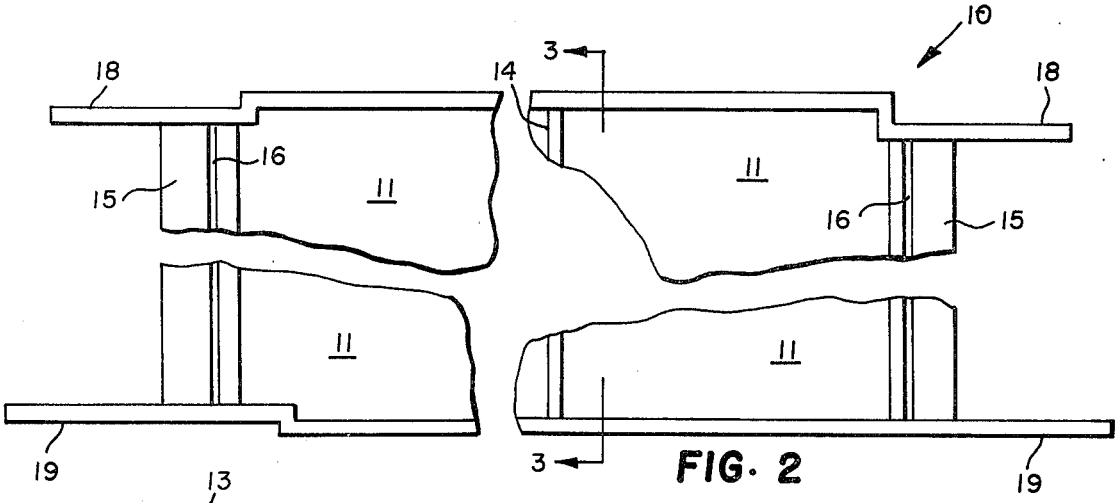
FIG. 2 is a fragmentary, rare elevational view of the panel of FIG. 1.
Figure 3:
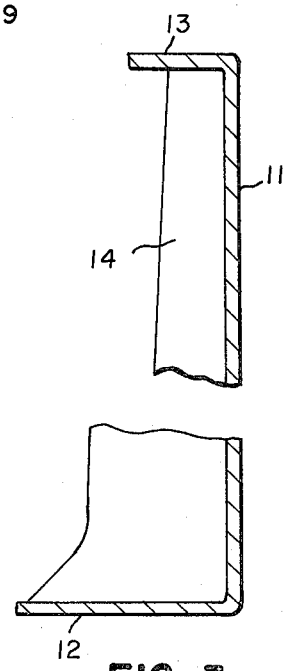
FIG. 3 is a cross-sectional view of the panel of FIG. 2, taken along the line 3—3 thereof.

A preferred form of panel 10 for an inground pool wall is shown in FIGS. 1–3. Panels 10 are formed with a facing wall 11, base flange 12, top flange 13, and vertical strengthening ribs 14 extending between the flanges. Panels 10 are preferably curved to approximate the arc of the assembled wall; but the curvature and other dimensions such as height, length, and configuration of flanges and ribs are variable. The distinctive configuration of panels 10 lies in their end regions where they are interconnected to form curved pool walls.

One connection between panels 10 joins them vertically along margins 15 at each end of facing wall 11 by means of an interlocking strip 20. Another connection joins both the lower flanges 12 and the upper flanges 13 with bolts or pins. The two connections cooperate to hold the panels securely in tension, involve their full margins 15 in an interlock, and maintain them securely at a predetermined orientation to each other.

Margins 15 are preferably thicker than wall 11 and generally aligned with wall 11 so they can be juxtaposed and joined together. Each margin 15 has an outer groove 16 and an inner groove 17 extending for the full vertical length of margin 15, and grooves 16 and 17 are spaced laterally apart and disposed obliquely to each other. Grooves 16 and 17 are also arranged so some resin material extends from facing wall 11 through to the edges of margins 15 without being intersected by grooves 16 and 17. This contributes to the strength of margins 15.

Grooves 16 are preferably parallel with the direction of release of panel 10 from its mold to facilitate molding. With panels 10 having a preferred curved shape and being releasable from the mold in a direction parallel with a radius intersecting their centers, grooves 16 oriented parallel with the release direction are inclined slightly inward to the tangent of margins 15 as illustrated. Grooves 17 are angled obliquely to grooves 16 and are formed by a mold element that moves relative to panels 10 when their mold opens and closes.

Flanges 12 and 13 extend beyond margins 15 in a region outward from margins 15 and are arranged at different levels to overlap when panels 10 are juxtaposed. The overlapping ends 18 of upper flange 13 are spaced radially outward from margins 15 to allow space for sliding a locking strip 20 vertically down over juxtaposed margins 15 to interlock panels 10. Overlapped ends 19 of lower flanges 12 preferably extend for the full width of lower flange 12 at the lower edge of margins 15 below the bottom of locking strip 20.

Overlapped flange ends 18 and 19 have holes positioned to register when panels 10 are juxtaposed in a predetermined orientation to each other. Flange ends 18 and 19 can then be bolted or pinned in this orientation to cooperate with locking strip 20 in maintaining panel orientation and bracing their interlock.

Rather than limiting panels 10 to an arc of a single radius so they can form only one curvature, the inventive system preferably accommodates arcs of several different radii. One arrangement making this possible is a plurality of holes 25 on flange overlaps 18 and 19 positioned so that different pairs of holes register at different predetermined orientations between panels 10. Because upper flange overlaps 18 are narrower, they preferably use a single row of holes 25 while wider lower flange overlaps 19 use a double row of similar holes 25. Panels 10 are preferably curved to fit an intermediate radius from which they can deviate slightly by being oriented at small angles to each other to approximate curves of larger and smaller radii. For each predetermined curvature, a set of holes 25 registers to receive a bolt or pin interlocking panels 10 in the proper orientation.

Figure 7:
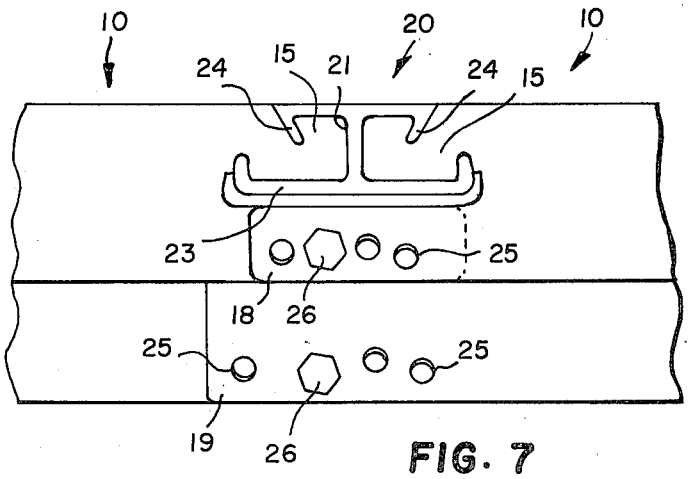
FIG. 7 is an enlarged plan view of a preferred way of joining pool panels according to the invention.

Connector strips 20 are preferably formed of extruded metal in cross-sectional shapes such as shown in FIGS. 7–9 to extend vertically for the full height of margins 15. The approximately H shape of locking strips 20 includes a cross web 21 disposed between juxtaposed margins 15 so that strip 20 straddles and holds margins 15 together. An inner span 22 and an outer span 23 each overlap juxtaposed margins 15, and the vertical edges of spans 22 and 23 have acutely in-turned ribs 24 that engage in grooves 16 and 17 of margins 15. This allows locking strips 20 to hold margins 15 securely together in a joint that distributes and resists tensile stress.

To accommodate different orientations of panels 10 to each other as explained above, locking strips 20 are preferably made at different angles to align with margins 15 at each orientation. The locking strip 20 interlocking panels 10 as shown in FIG. 7 is made straight with its spans 22 and 23 extending at 180° angles to align with panels 10 oriented to fit an arc matching their curvature. Locking strip 20*a* as shown in FIG. 8 has a wedge-shaped cross web 21*a* disposing spans 22 and 23 at an angle to align with panels oriented to approximate an arc of a smaller radii. This also registers a different set of holes 25 in overlapping flange ends 18 and 19 for placing connector pins or bolts in a different position to brace panels 10 at the desired orientation. Locking strip 20*b* of FIG. 9 has a wedge-shaped cross web 21*b* in an opposite orientation to dispose spans 22 and 23 at an angle appropriate for panels juxtaposed to approximate arcs of larger radii.

Although arcs of many different radii are possible, a preferred way of practicing the inventive connector system is to make panels 10 in moderate lengths so that from 12 to 18 panels can be used to form circles having diameters ranging from 18 feet to 27 feet. Flange overlaps 18 and 19 are long enough to accommodate 4 sets of holes 25 registering at 4 different interpanel orientations approximating 4 different radii of curvature. Holes 25 and locking strips 20 are preferably marked for each respective diameter. Workmen can then juxtapose panels 10, slide on the proper locking strips 20, and bolt or pin the indicated flange overlaps 18 and 19 to establish the desired diameters and secure interlocks in a simple and effective way. Less than a full circle of panels can also be made, and arcs of different lengths can be mixed or combined with straight sections.

Panels 30 made for above ground pool walls preferably have a modified upper region that includes a molded coping 31, a liner retention slot 32, and double flange overlaps 33 and 34 arranged to double the overlapping and interlocking flange area and strengthen the upper perimeter of the pool wall when the flanges are bolted together. The upper flange is also made wider and combined with the bottom of coping 31 so that the upper flange overlaps 33 and 34 can accommodate double sets of registry holes 25 for further strengthening the panel interlock.

These changes in the upper part of the pool wall can be made by interchangeable elements in the upper region of the mold that forms the panels. Also, coping 31, liner retention slot 32, and flange overlaps 33 and 34 are preferably configured as illustrated to be formed along the release line of the mold for simplicity and economy. Coping 31 is open on the outward side and can be closed with a trim strip, and the outward opening of coping 31 can also be used for connecting decks or other structures to the pool wall.

Except for enlarging and doubling the upper flange overlaps 33 and 34, requiring 2 bolts or pins joining the upper part of the wall, assembly of panels 30 uses the same method as previously described.

We claim:

1. A system of interconnected molded resin panels forming a curved pool wall, each of said panels having a facing wall, base flange, and top flange, and said system comprising:

a. each end of said facing wall having a vertical margin approximately aligned with said facing wall and juxaposed between adjacent panels;

b. each of said margins having an inner groove and an outer groove that extend vertically and are laterally spaced and oblique to each other;

c. a locking strip arranged vertically to straddle and hold a joint between said adjacent panels positioned in a predetermined orientation to each other;

d. said locking strip being generally H-shaped in cross section and having a cross web disposed between said juxtaposed margins and inner and outer spans overlapping said juxtaposed margins;

e. the vertical edges of said inner and outer spans having acutely in-turned ribs engaged in said grooves in said margins;

f. said bottom and top flanges extending beyond said margins in a region outward from said margins and being arranged to overlap in said predetermined orientation; and g. bolts connecting said overlapped flanges.

2. The system of claim 1 wherein said grooves in said margins are arranged so some resin material extends from said facing wall through to the edges of said margins without being intersected by said grooves.

3. The system of claim 1 wherein said outer grooves in said margins are parallel with the direction of release of said panel from its mold.

4. The system of claim 1 wherein said margins are offset from said facing wall enough to position said inner span of said locking strip flush with said facing wall.

5. The system of claim 4 wherein said grooves in said margins are arranged so some resin material extends from said facing wall through to the edges of said margins without being intersected by said grooves.

6. The system of claim 5 wherein said panels are curved and said outer grooves in said margins are parallel with the direction of release of said panel from its mold.

7. The system of claim 1 wherein said top flanges include double overlapping projections bolted together.

8. The system of claim 7 wherein said top flanges include a coping and a liner retention slot.

9. The system of claim 1 wherein said predetermined orientation is variable and said overlapped flanges have holes positioned to register for each of said predetermined orientations.

10. The system of claim 9 wherein said locking strips are angled to align with said predetermined orientations.

11. The system of claim 9 wherein said panels are curved, and said predetermined orientations approximate arcs of different radii.

12. The system of claim 11 wherein said locking strips are angled to align with said predetermined orientations.

13. The system of claim 12 wherein said outer grooves in said margins are parallel with the direction of release of said panel from its mold.

14. The system of claim 13 wherein said grooves in said margins are arranged so some resin material extends from said facing wall through to the edges of said margins without being intersected by said grooves.

15. The system of claim 14 wherein said margins are offset from said facing wall enough to position said inner span of said locking strip flush with said facing wall.

16. The system of claim 15 wherein said top flanges include double overlapping projections bolted together.

17. The system of claim 16 wherein said top flanges include a coping and a liner retention slot.

* * * * *